US006502337B1

(12) United States Patent
Ochi

(10) Patent No.: US 6,502,337 B1
(45) Date of Patent: Jan. 7, 2003

(54) DECORATIVE DISPLAY APPARATUS

(75) Inventor: Yasushi Ochi, Osaka (JP)

(73) Assignee: Oriental Sangyo, Ltd., Osaka (JP)

( * ) Notice: Subject to any disclaimer, the term of this patent is extended or adjusted under 35 U.S.C. 154(b) by 0 days.

(21) Appl. No.: 09/624,229

(22) Filed: Jul. 24, 2000

(51) Int. Cl.[7] ..... G09F 19/00
(52) U.S. Cl. ..... 40/406; 40/409
(58) Field of Search ..... 40/406, 409, 410, 40/412, 439; 446/178, 179

(56) References Cited

U.S. PATENT DOCUMENTS

| | | | | | |
|---|---|---|---|---|---|
| 2,361,346 | A | * | 10/1944 | Atkins | 40/409 |
| 2,543,606 | A | * | 2/1951 | Solomon et al. | 40/410 |
| 4,190,312 | A | * | 2/1980 | Bailey | 350/4.2 |
| 4,601,471 | A | * | 7/1986 | Frank | 273/144 B |
| 5,098,111 | A | * | 3/1992 | Kashimoto | 273/457 |
| 5,121,920 | A | * | 6/1992 | Laezzo et al. | 273/144 B |
| 5,313,727 | A | * | 5/1994 | Murray, Jr. | 40/410 |
| 5,711,099 | A | * | 1/1998 | Nesbit et al. | 40/406 |
| 5,979,091 | A | * | 11/1999 | TenBrink | 40/410 |

FOREIGN PATENT DOCUMENTS

JP 10-69246 * 3/1998

OTHER PUBLICATIONS

Patent Abstract of PCT No. WO99/59690 dated Nov. 25, 1999.
Patent Abstract of Japan No. 2000–037563, dated Feb. 8, 2000.
Patent Abstract of Japan No. 8–126769, dated May 21, 1996.
Patent Abstract of Japan No. 10–066785, dated Mar. 10, 1998.

* cited by examiner

*Primary Examiner*—Jack Lavinder
*Assistant Examiner*—Bradley King
(74) *Attorney, Agent, or Firm*—Armstrong, Westerman & Hattori, LLP

(57) ABSTRACT

A decorative display apparatus which gives unique aesthetic feelings and strong impressions to people. A pair of opposed members are disposed in a spaced and parallel relationship and at least one of the opposed members is transparent or translucent. A surrounding structure for forming an inside space between the pair of opposed members is provided with an air inlet. A plurality of balloons are placed in the inside space. Also provided are an air supply device to generate an air stream in the inside space, and at least one air outlet adjacent the air inlet and/or in a portion of at least one of the opposed members except a peripheral portion thereof. A circling air stream is generated in the inside space, whereby the plurality of balloons are brought into circling movement, which can be observed from outside the display apparatus.

8 Claims, 7 Drawing Sheets

DECORATIVE DISPLAY APPARATUS

BACKGROUND OF THE INVENTION

1. Field of the Invention

The present invention relates to a decorative display apparatus which is mounted on a window, a wall, a floor or a ceiling of a building, or fitted into them, or used as a partition in the room to give aesthetic feelings and good impressions to people.

2. Description of Related Art

For advertisement of commodity products or for improvement of corporate images, illustrations such as human figures and landscapes, photographs and posters are provided on window glasses of a building, and dolls and other decorative objects are displayed in a display space inside the window glasses. Such attempts give aesthetic feelings and good impressions to pedestrians to attract them. Further, various decorative objects are arranged in stores to create vivid and cheerful atmospheres in the stores.

These static decorative objects and the like indeed give aesthetic feelings andimpressions to people, but are commonplace. Therefore, this kind of decoration merely gives trite impressions, failing to give unique and distinctive feelings and stronger impressions to people who are accustomed thereto.

SUMMARY OF THE INVENTION

In view of the foregoing, it is an object of the present invention to provide a decorative display apparatus which gives novel and unique aesthetic feelings and stronger impressions to people.

In accordance with the present invention, there is provided a decorative display apparatus, which comprises: a pair of opposed members disposed in a spaced and parallel relation, at least one of the opposed members being transparent or translucent; surrounding means for forming the inside space between the pair of opposed members, and provided with an air inlet; a plurality of balloons placed in the inside space; air supply means for supplying air into the inside space from the air inlet to generate an air stream in the inside space; and at least one air outlet provided adjacent the air inlet in the surrounding means and/or in a portion of at least one of the opposed members except a peripheral portion thereof.

When the air is supplied into the inside space through the air inlet from the air supply means, the supplied air hits against an interior surface portion of the surrounding means opposed to the air inlet thereby to be deflected along the interior surface portion. As a result, a circling air stream is generated, which flows along the interior surface of the surrounding means. The balloons placed in the inside space are brought into circling movement by the circling air stream. The circling movement of the balloons is observed through the transparent or translucent member.

The present invention provides a dynamic decorative effect wherein the plurality of balloons are simultaneously kept in circling movement. Thus, novel and unique aesthetic feelings and stronger impressions are given to people. Further, the decorative display apparatus has a simplified construction and is constituted by less expensive components, so that the novel dynamic decorative effect can be provided at very low costs.

If the inside space was an enclosed space, the internal pressure of the inside space would be increased by the air supplied from the air supply means, so that the air supply amount would gradually decrease to weaken the circling air stream. In accordance with the present invention, however, the air is moderately expelled from the inside space through the air outlet, so that the circling air stream is prevented from being weakened by excess build-up of the internal pressure of the inside space. Thus, the strength of the circling air stream can be maintained at a proper level.

Where the air outlet is provided at least adjacent the air inlet, air around the air inlet is drawn into the inside space by the air stream generated by the air supply means, so that the circling air stream flowing in the vicinity of the air outlet is hardly affected to be slowed down by an air stream expelled from the air outlet. Therefore, the speed of the circling air stream can be maintained at a desired level. Where the air outlet is provided in the portion of the opposed member except the peripheral portion thereof, i.e., where the air outlet is provided in association with the center of the circling air stream, the speed of the circling air stream is hardly affected by the presence of the central air outlet, because the circling air stream has the highest speed at the outermost portion thereof and a relatively low speed at the center thereof. Therefore, the speed of the circling air stream can be maintained at the desired level. As long as the speed of the circling air stream can be maintained at the desired level, air outlets are not necessarily required to be provided both in the peripheral member and in the opposed member, but may be provided in one of these members.

The provision of the air inlet and the air outlet in the peripheral member is achieved by forming openings directly in the peripheral member or by providing the peripheral member in discontinuous manner.

In the decorative display apparatus, at least one of the opposed members is rectangular in shape, and the surrounding means consists of four or more peripheral members, wherein the air inlet is provided in one of the two adjacent peripheral members near a corner of the rectangular opposed plate. In this case, the air supply means supplies the air into the inside space along the other of the two adjacent peripheral members.

With this arrangement, the air supplied from the air inlet hits against the interior surface portion of the peripheral member opposed to the air inlet thereby to be deflected along the inner surface portion of the peripheral member. As a result, a circling air stream is generated, which flows along the interior surface of the peripheral member. Therefore, the same effect as described above can be provided.

The decorative display apparatus further comprises oblique plates disposed near the other corners of the rectangular opposed member, wherein each of the oblique plates connects to the two adjacent peripheral members providing each of the corners. In other words, the oblique plates guide the air stream as to be deflected, so that an energy loss is reduced at the deflection of the air stream. Therefore, a stronger circling air stream can easily be generated.

The rectangular plate member preferably has an aspect ratio of 1.0 to 1.5. The term "aspect ratio" herein means the ratio of the length of the long side to the short side of the rectangular plate member. With this arrangement, the circling air stream can flow generally circularly. Therefore, the balloons can be brought into circular motion thereby to provide a well-balanced dynamic decorative effect as a whole.

In the decorative display apparatus, at least one of the opposed members may be a generally rectangular plate member that has an aspect ratio of 1.6 to 3.0. In this case, the air inlet is provided in a generally longitudinally middle portion of the peripheral member along one of the longer sides of the rectangular plate member.

With this arrangement, the air supplied from the air inlet hits against the interior surface portion of the peripheral member opposed to the air inlet thereby to be deflected in two opposite directions (or in laterally opposite directions) along the interior surface portion of the peripheral member. Therefore, two circling air streams are generated in right and left portions of the inside space, so that the balloons placed in the inside space are brought into circling movement on these circling air streams thereby to be divided into two groups. This provides a dynamic decorative effect different from those described above.

In this case, oblique plates may be provided in the four corners of the peripheral member in the inside space with each of the oblique plates connecting to the two adjacent peripheral member providing each of the corners. This arrangement provides the same effect as described above. That is, each of the oblique plates guides the air streams to be deflected, so that an energy loss is reduced at the deflection of the air streams. Therefore, stronger circling air streams can easily be generated.

The decorative display apparatus may further comprise diverting means opposed to the air inlet. With this arrangement, the air stream from the air inlet can easily be diverted into two directions, so that an energy loss is reduced at the diversion of the air stream. Therefore, stronger circling air streams can easily be generated.

In the decorative display apparatus, at least one of the pair of opposed members may be a generally equilateral polygonal plate member with five or more straight sides and the surrounding means consists of five or more peripheral members. In the case, the air inlet is provided in one of the two peripheral members near a corner of the polygonal plate, and the air supply means supplies the air into the inside space along the other of the two adjacent peripheral members providing the corner.

In the decorative display apparatus, at least one of the opposed members may be a round or oval plate member. In this case, the air supply means supplies the air along a tangent of the round or oval plate member. With this arrangement, a stronger air stream can easily be generated.

In the decorative display apparatus, the air supply means preferably supplies the air in a variable direction. Thus, variations and irregularity are imparted to the circling movement of the balloons, thereby enhancing the dynamic decorative effect.

Exemplary materials for the plate member herein employed include plates and sheets (including woven fabrics and knitted fabrics) having any thickness.

DETAILED DESCRIPTION OF THE INVENTION

With reference to the attached drawings, the present invention will hereinafter be described in detail by way of embodiments thereof.

Figure 1:
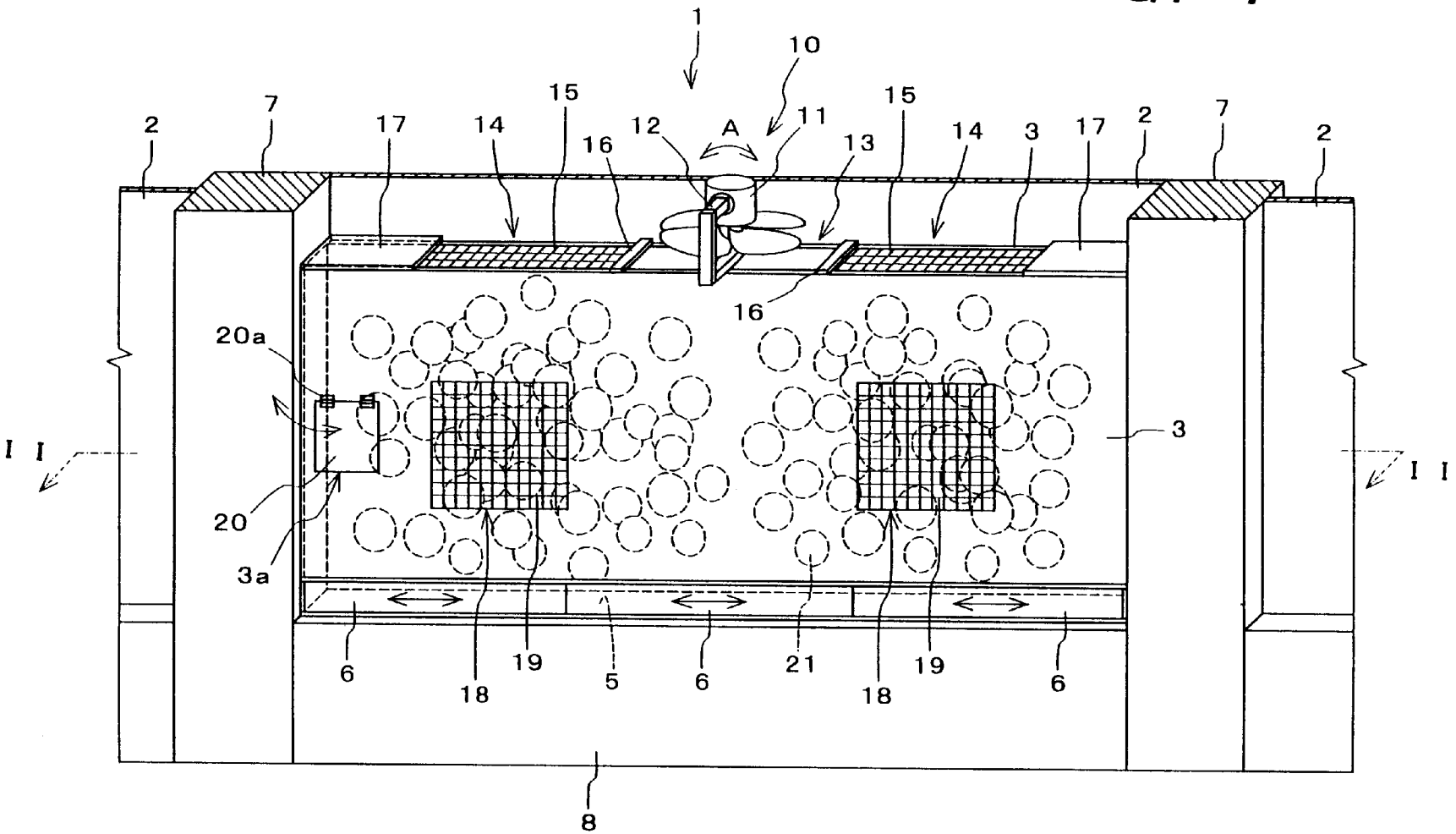
FIG. 1 is a perspective view illustrating a decorative display apparatus according to one embodiment of the present invention.
Figure 2:
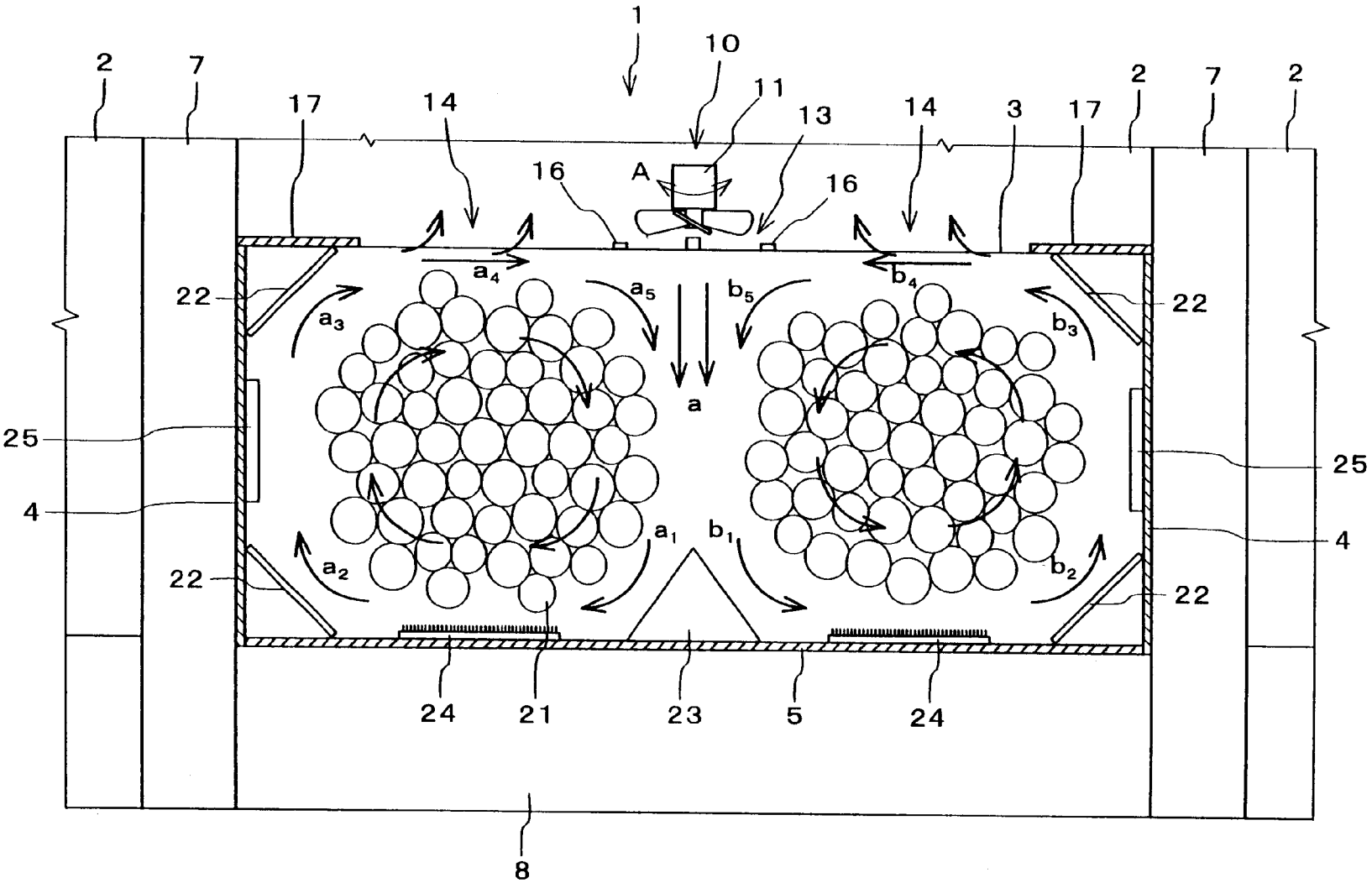
FIG. 2 is a sectional view as seen in the direction of an arrow line II—II in FIG. 1.

One embodiment of the invention will be described with reference to FIGS. 1 and 2. FIG. 1 is a perspective view illustrating a decorative display apparatus according to this embodiment, and FIG. 2 is a sectional view.as seen in the direction of an arrow line II—II in FIG. 1.

As shown in FIG. 1, the decorative display device 1 of this embodiment is installed in the vicinity of a window of abuilding. More specifically, the decorative display apparatus 1 is disposed on a base 8 provided between pillars 7, 7 inside a window glass 2 fitted between the pillars 7, 7 in the building. As shown in FIGS. 1 and 2, the decorative display apparatus 1 includes: a pair of panels 3, 3 provided as the pair of opposed members in a spaced and parallel relation to define an inside space therebetween; a bottom plate 5, side plates 4, 4 and top plates 17, 17 provided as the peripheral member along bottom edges, side edges and top edges, respectively, of the pair of panels 3, 3 as surrounding the inside space; air supply means 10 provided on a generally laterally middle portion between the top edges of the pair of panels 3, 3; and a multiplicity of balloons 21 retained in the inside space surrounded by the pair of panels 3, 3, the bottom plate 5, the side plates 4, 4 and the top plates 17, 17. The shape, color and number of the balloons 21 are not particularly limited.

The bottom plate 5, the side plates 4, 4 and the top plates 17, 17 as the peripheral member are provided along the peripheries of the panels 3, 3 with the laterally middle portion between the top edges of the panels 3, 3 being open. That is, the top plates 17, 17 are disposed in a spaced relation on upper corner portions between the panels 3, 3. An air inlet 13 and two air outlets 14, 14 are provided in the open middle portion. In other words, this construction is equivalent to a construction such that the top of the inside space defined between the panels 3, 3 is covered with a single top plate 17, which has an air inlet 13 and air outlets 14, 14 provided in a middle portion thereof. Mesh members 15, 15 are respectively provided on the air outlets 14, 14 with peripheral portions thereof being fixed to the top plates 17, 17, fixture plates 16, 16 and the panels 3, 3. The mesh members 15, 15 prevent the balloons 21 retained in the inside space from being expelled through the air outlets 14, 14.

The air supply means 10 which is provided above the air inlet 13 includes a bracket 12 fixed to the top edges of the panels 3, 3 over the laterally middle portion, and a blower 11 supported by the bracket 12 for supplying air into the inside space through the air inlet 13. The blower 11 is driven by driver means incorporated therein so as to be pivoted in the directions of arrows A about a support of the bracket 12, whereby an air supply direction in which the air is supplied into the inside space can correspondingly be changed. The blower 11 is adapted to change an air supply amount per unit time.

The panels 3, 3 are rectangular plates, at least one of which is transparent or translucent. Where the decorative display apparatus 1 is adapted to provide a decorative effect when viewed from the outside of the building, at least the panel 3 adjacent to the window glass 2 is transparent or translucent. Where the decorative display apparatus 1 is adapted to provide the decorative effect when viewed from the inside of the building, at least the panel 3 on the inner side (the panel 3 away from the window glass 2) is transparent or translucent. Where the decorative display apparatus 1 is adapted to provide the decorative effect when viewed from the inside and outside of the building, the panels 3, 3 are both transparent or translucent. Where either one of the panels 3 is opaque, the opaque panel may be a mirror plate having a reflective surface opposed to the other panel.

In this embodiment, two air outlets 18, 18 are provided in the panel 3 on the inner side. More specifically, the air outlets 18, 18 are provided in portions of the panel 3 except a peripheral portion thereof. Similarly to the air outlets 14, 14, the air outlets 18, 18 are respectively provided with mesh members 19, 19, whereby the balloons 21 retained in the inside space are prevented from being expelled through the air outlets 18, 18.

The panel 3 on the inner side is provided with a pivotal plate 20 which is attached thereto via hinges 20*a* so as to be pivotal in arrow directions. An opening formed in the inner panel 3 is covered and uncovered by closing and opening the pivotal plate 20. The inner panel 3 further has three slidable plates 6 provided in a lower portion thereof movably in arrow directions. Openings formed in the lower portion is covered and uncovered by sliding the slidable plates 6 in the arrow directions.

As shown in FIG. 2, oblique plates 22 are provided in four corners of the inside space defined between the panels 3. Opposite ends of the oblique plates 22 are fixed to the interior faces of the peripheral member (interior surfaces of the bottom plate 5, the side plates 4, 4 and the top plates 17, 17) at an angle of 45 degrees with respect to the interior surfaces. The oblique plates 22 are not necessarily required to be planar plates as shown in FIG. 2, but may be arcuate plates which project toward the respective corners. Diverting means 23 is provided on the bottom plate 5 in a position opposed to the blower 11. The diverting means 23 has a triangular-column shape having three peripheral faces one of which faces downward and the other of which are inclined as shown in FIG. 2.

Illumination devices 25, 25 are provided on the opposed interior surfaces of the side plates 4, 4 for illumination of the inside space. Static electricity eliminating means 24, 24 are provided between the oblique plates 22 and the diverting means 23 on the bottom plate 5. The static electricity eliminating means 24, 24 have a plurality of standing conductive fibers which are properly grounded.

Next, an explanation will be given to the decorative effect of the decorative display apparatus 1 according to this embodiment. It is noted that the blower 11 is located in the position shown in FIG. 2.

When the air is supplied into the inside space through the air inlet 13 by the blower 11, an air stream (as indicated by an arrow a) is generated to be directed toward the diverting means 23 from the blower 11, and diverted into two air streams (as indicated by arrows $a_1$ and $b_1$) by the diverting means 23. The air stream diverted in the direction of the arrow $a_1$ is deflected in the direction of an arrow $a_2$ and then in the direction of an arrow $a_3$ by the oblique plates 22, 22. The deflected air stream flows in the direction of an arrow $a_4$ and then in the direction of an arrow $a_5$, thereby joining with the air stream flowing in the direction of the arrow a. Thus, a circling air stream is generated to flow in the directions of the arrows a to $a_5$. Similarly, the air stream diverted in the direction of the arrow $b_1$ is deflected in the direction of an arrows $b_2$ and then in the direction of an arrow $b_3$ by the oblique plates 22, 22. The deflected air stream flows in the direction of an arrow $b_4$ and then in the direction of an arrow $b_5$ thereby joining with the air stream flowing in the direction of the arrows a. Thus, a circling air stream is generated to flow in the directions of the arrows a and $b_1$ to $b_5$.

If the inside space was an enclosed space, the internal pressure of the inside space would be increased by the air continuously supplied into the inside space through the air inlet 13, so that the air supply amount would gradually decrease to weaken the circling air streams. In accordance with this embodiment, however, the decorative display apparatus 1 has the air outlets 14, 14, 18, 18, so that the air is properly expelled from the inside space through the air outlets 14, 14, 18, 18. This prevents the circling air streams from being weakened by excessive build-up of the internal pressure of the inside space. Therefore, the strength of the circling air streams can be maintained to a proper level.

The plurality of balloons retained in the inside space are divided into two groups, i.e., right and left groups, by the two circling air streams thus generated, and the two groups of balloons are brought into circling movement in the arrow directions on the respective circling air streams. The circling movement of the balloons 21 is observed through the transparent or translucent panel 3. Thus, the decorative display apparatus 1 provides a dynamic decorative effect wherein the plurality of balloons 21 are simultaneously kept in circling movement thereby to give novel and unique aesthetic feelings and stronger impressions to people. Since the decorative display apparatus 1 has a simplified construction and is constituted by less expensive components, the novel and unique dynamic decorative effect can be provided at very low costs.

The circling movement of the balloons is achieved by bringing the balloons into circular motion. In this respect, the panels 3, 3 preferably have an aspect ratio of 1.6 to 3.0. Thus, the circling air streams flow generally circularly. As a result, the two groups of balloons are kept in generally circular motion. The pair of panels 3, 3 are preferably spaced by a distance which equals to about 1.2 to 1.8 times the diameter of the greatest balloon 21 to cause the two groups of balloons to be brought into collective and regular circling movement. Where the distance between the panels is about 2.2 to 3 times the diameter of the greatest balloon 21, the two groups of balloons are kept in circling movement as a whole while the balloons individually moves irregularly. As a result, a decorative and aesthetic effect different from that described above is provided.

Since the air outlets 14, 14 are provided adjacent the air inlet 13 on opposite sides thereof in this embodiment, the air around the air inlet 13 is drawn into the inside space by the air stream flowing in the direction of the arrow a from the blower 11. Therefore, the speeds of the circling air streams flowing in the directions of the arrows $a_4$, $a_5$, $b_4$ and $b_5$ are hardly affected to be reduced by air streams flowing out through the air outlets 14, 14, so that the speeds of the circling air streams can be maintained at a desired level. The air outlets 18, 18 are provided in the portions of the panel 3 except the peripheral portion thereof, i.e., in association with the centers of the circling movements of the circling air streams. This arrangement is also effective for maintaining the speeds of the circling air streams at the desired level. More specifically, the circling air streams each have the highest speed at the outermost portion thereof and a relatively low speed at the center thereof. Therefore, the speeds of the circling air streams are hardly affected by the middle openings of the panel 3. If the air is supplied at an excessively high flow rate by the blower 11, the air streams flow out at a higher speed through the air outlets 14, 14, 18, 18, so that the balloons 21 may be clung to the mesh members of the air outlets 14, 14, 18, 18. Therefore, the open areas of the air outlets 14, 14, 18, 18 should be determined so as to prevent such an inconvenience. As long as the air outlets have a sufficiently great total open area, it is not necessary to provide both the air outlets 14, 14 and the air outlets 18, 18, but either of the air outlets 14, 14 and the air outlets 18, 18 may be provided.

In this embodiment, the inside space is illuminated by the illumination means 25. Therefore, the balloons in circling movement are successively illuminated, so that the dynamic decorative effect is enhanced. Where a black light is employed as the illumination means 25 and the balloons have fluorescent colors, the balloons are lit up, thereby providing an aesthetic effect different from that described above. Further, neon flash lamps may be flashed on and off with music, whereby a further different aesthetic effect can be provided.

As described above, one of the panels 3 may be a mirror plate. In this case, the balloons 21 in circling movement can be seen as reflection in the mirror thereby to look more bustling. This enhances the dynamic aesthetic affect. Further, the plate 3 may be a waved or undulated mirror plate. In this case, the reflection of the balloons is seen in different ways depending on a viewpoint. Alternatively, a mirror member may be disposed outside the transparent panel 3 to provide a similar aesthetic effect.

Further, the blower 11 is pivotal in the directions of the arrow A in this embodiment. When the blower 11 is pivoted in one of the directions of the arrow A, the speed of one of the circling air streams toward which the blower 11 is directed is increased, so that the balloons are brought into more vigorous circling movement. On the contrary, the speed of the other circling air stream is reduced, so that the balloons are brought into slower circling movement. Thus, the circling movements of the two groups of balloons can variously be changed, whereby the dynamic aesthetic effect can further be enhanced.

The balloons in circling movement are liable to be electrostatically charged due to mutual friction contact thereby to be attracted to each other. This may slow down the circling movements of the balloons. In this embodiment, however, the balloons in circling movement are brought into contact with the static electricity eliminating means 24 provided in the inside space, so that the static electricity can be eliminated for prevention of the above problem. Therefore, the balloons 21 can be kept in vigorous circling movement for an extended period. Instead of the aforesaid construction, a humidifier may be employed as the static electricity eliminating means 24.

In the decorative display apparatus 1 according to this embodiment, the internal pressure of the inside space is increased by the air supplied by the blower 11 as described above, so that the inside air is expelled through the opening 3*a* by opening the pivotal plate 20. At this time, some of the balloons 21 are also expelled through the opening 3*a*. Therefore, the balloons 21 can easily be taken out of the inside space by opening the pivotal plate 20 as required. Thus, the inside balloons 21 can quickly be replaced with those having a different shape and color. This makes it possible to quickly alter the aesthetic effect provided by the apparatus 1. In this respect, the pivotal plate 21 is preferably located in a position where the inside circling air streams flow at a higher speed. Needless to say, the pivotal plate 20 can be locked in a closed state. If some of the inside balloons 21 happen to burst due to mutual friction contact, the collapsed balloons can easily be removed by opening the slidable plates 6 provided on the lower side of the panel 3.

While the decorative display apparatus 1 according to this embodiment of the invention has thus been described, modifications may be made thereto. For example, the oblique plates 22 and the diverting means 23 may be obviated, if circling air streams of an appropriate speed can be generated. The provision of the oblique plates 22 and the diverting means 23 ensures generation of circling air streams of a higher speed. Even without the provision of the oblique plates and the diverting means, the air supplied from the air inlet 13 hits against the bottom plate 5, the side plates 4, 4 and the top plates 17, 17 to form the circling air streams with a little energy loss. Therefore, if the supplied air has a sufficiently high speed, the oblique plates 22 and the diverting means 23 need not be provided, or may selectively be provided as required.

Figure 3:
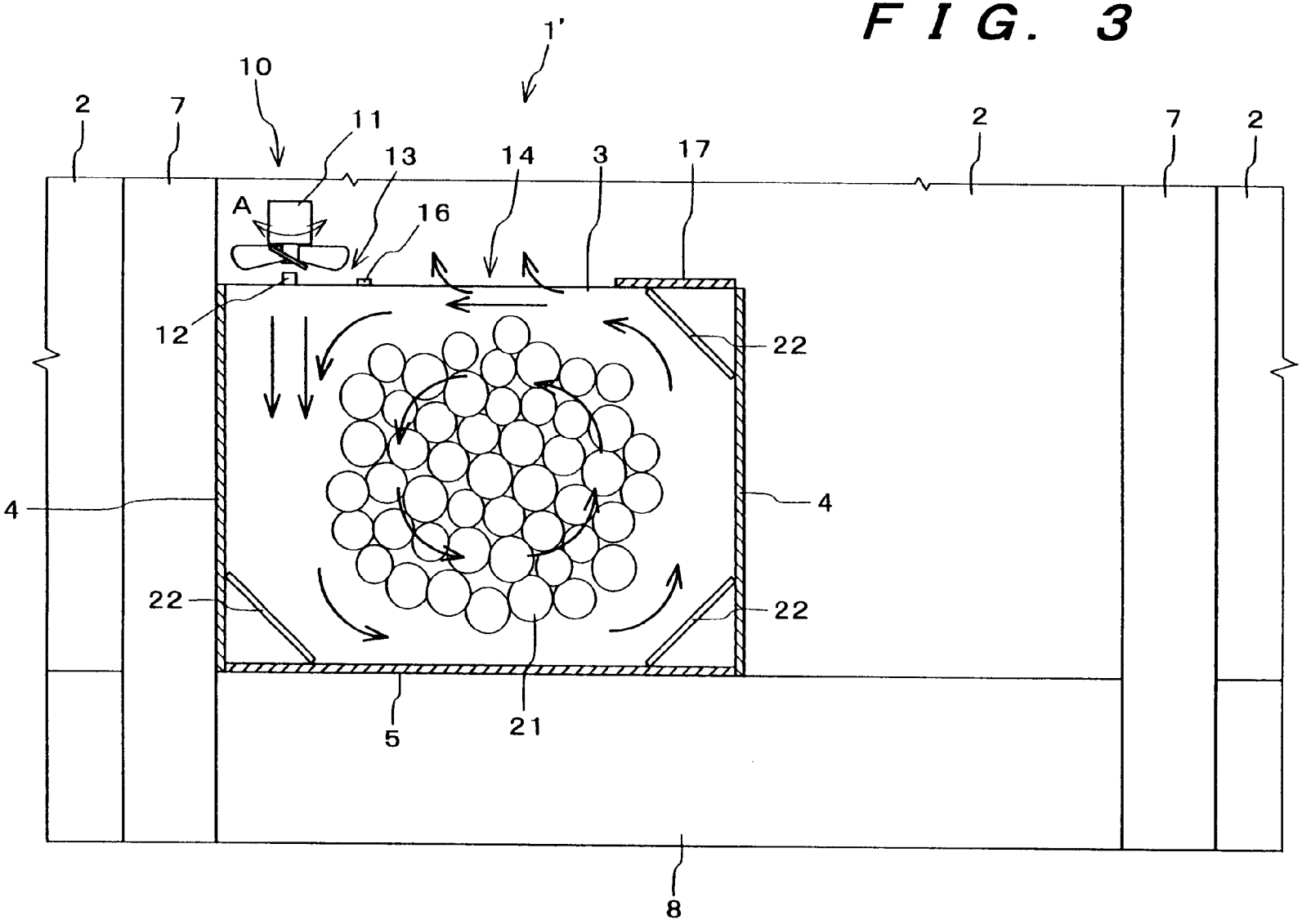
FIG. 3 is a sectional view illustrating a decorative display apparatus according to a modification of the embodiment.
Figure 4:
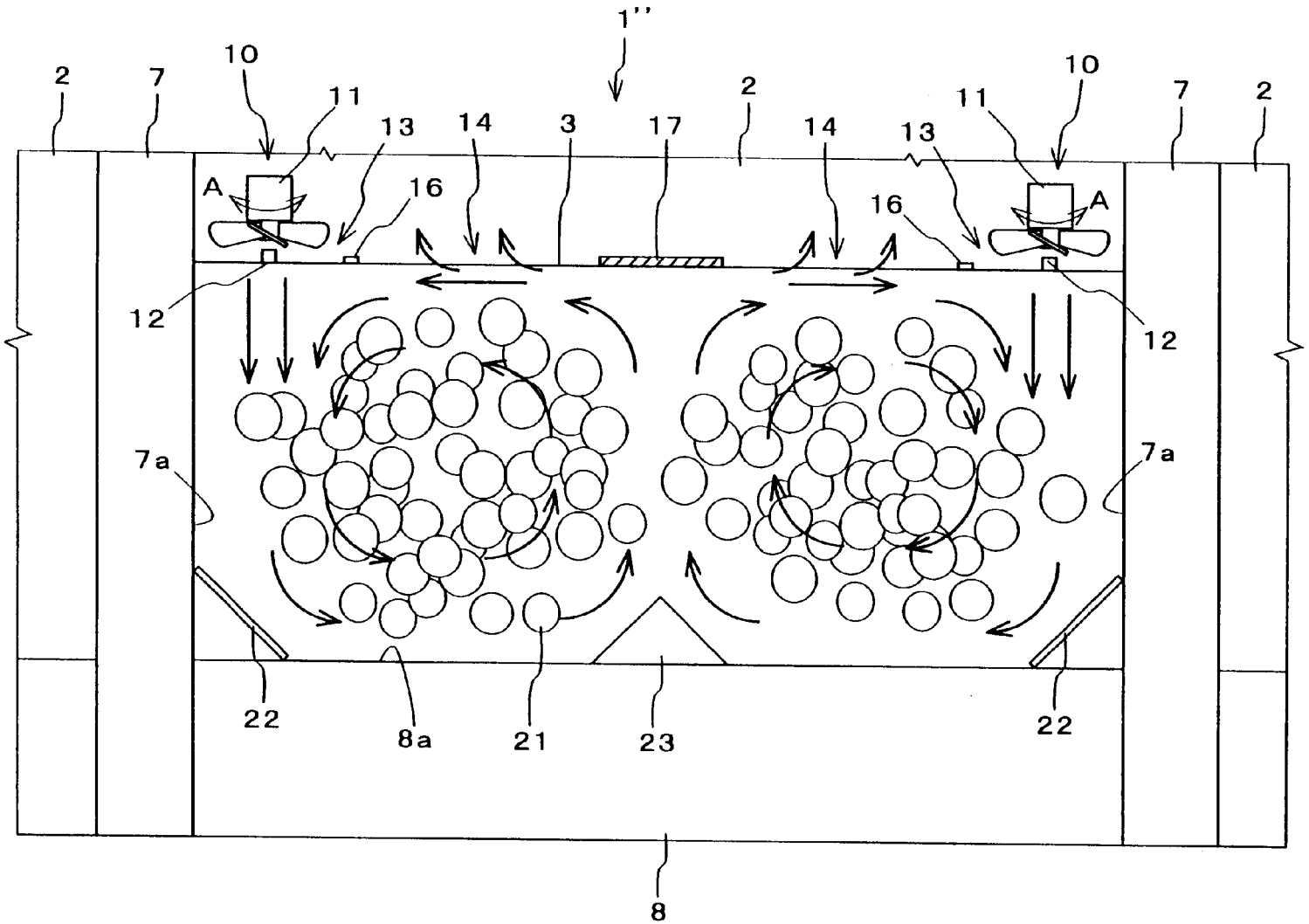
FIG. 4 is a sectional view illustrating a decorative display apparatus according to another modification of the embodiment.

Although the single air supply means 11 is provided on the laterally middle portion between the top edges of the panels 3, 3, any number of air supply means 11 may be provided in any other positions. For example, single air supply means may be provided on one of the upper corners of the inside space as shown in FIG. 3, or two air supply means may be provided on the upper corners of the inside space as shown in FIG. 4. Alternatively, single air supply means may be provided at a lower portion of one of the side plates 4, or two air supply means may be provided at lower portions of the side plates 4 as opposed to each other, though not illustrated.

A decorative display apparatus 1' shown in FIG. 3 is constituted by a right half of the decorative display apparatus 1 shown in FIG. 2. Therefore, like components are denoted by like reference characters in FIGS. 2 and 3, and a detailed explanation will not be given thereto. In the decorative display apparatus 1', panels 3, 3 have an aspect ratio of 1.0 to 1.5 so that circling air streams can flow generally circularly. As a result, balloons 21 can collectively be brought into generally circular motion. By pivoting the blower 11 in the directions of an arrow A, the balloons 21 are stirred in the inside space thereby to be moved vigorously and irregularly. The balloons 21 are moved regularly or irregularly as desired by properly driving the blower 11, so that various aesthetic effects can be provided.

In a decorative display apparatus 1" shown in FIG. 4, two air supply means 10 each having the same construction as that of the decorative display apparatus 1 shown in FIG. 2 are provided on upper corner portions between top edges of a pair of panels 3, and a top plate 17 is provided on a laterally middle portion between the top edges of the panels. Further, side faces 7*a*, 7*a* of pillars 7, 7 and an upper face 8*a* of a base are utilized instead of the side plates 4, 4 and the bottom plate 5, respectively, to surround an inside space defined between the panels 3, 3. Thus, the decorative display apparatus 1" is formed integrally with structural components of a building, e.g., a window glass, walls, a floor and a ceiling. In FIG. 4, components of the decorative display apparatus 1" corresponding to those of the decorative display apparatus 1 are denoted by the same reference characters as in FIG. 1, and a detailed explanation is not given thereto.

Although the panels 3, 3 are used as the pair of opposed members, the material for the opposed members is not limited thereto. For example, a sheet material (including a woven fabric and a knitted fabric) may be employed. In this case, the sheet material is preferably fitted in a peripheral frame so as to be imparted with shape retainability. Although the blower 11 as the air supply means is herein illustrated as a fan, a compressed air supply mechanism may be employed which includes a compressor, an air supply pipe, a selector valve and a jet nozzle for supplying compressed air into the inside space.

Figure 5:
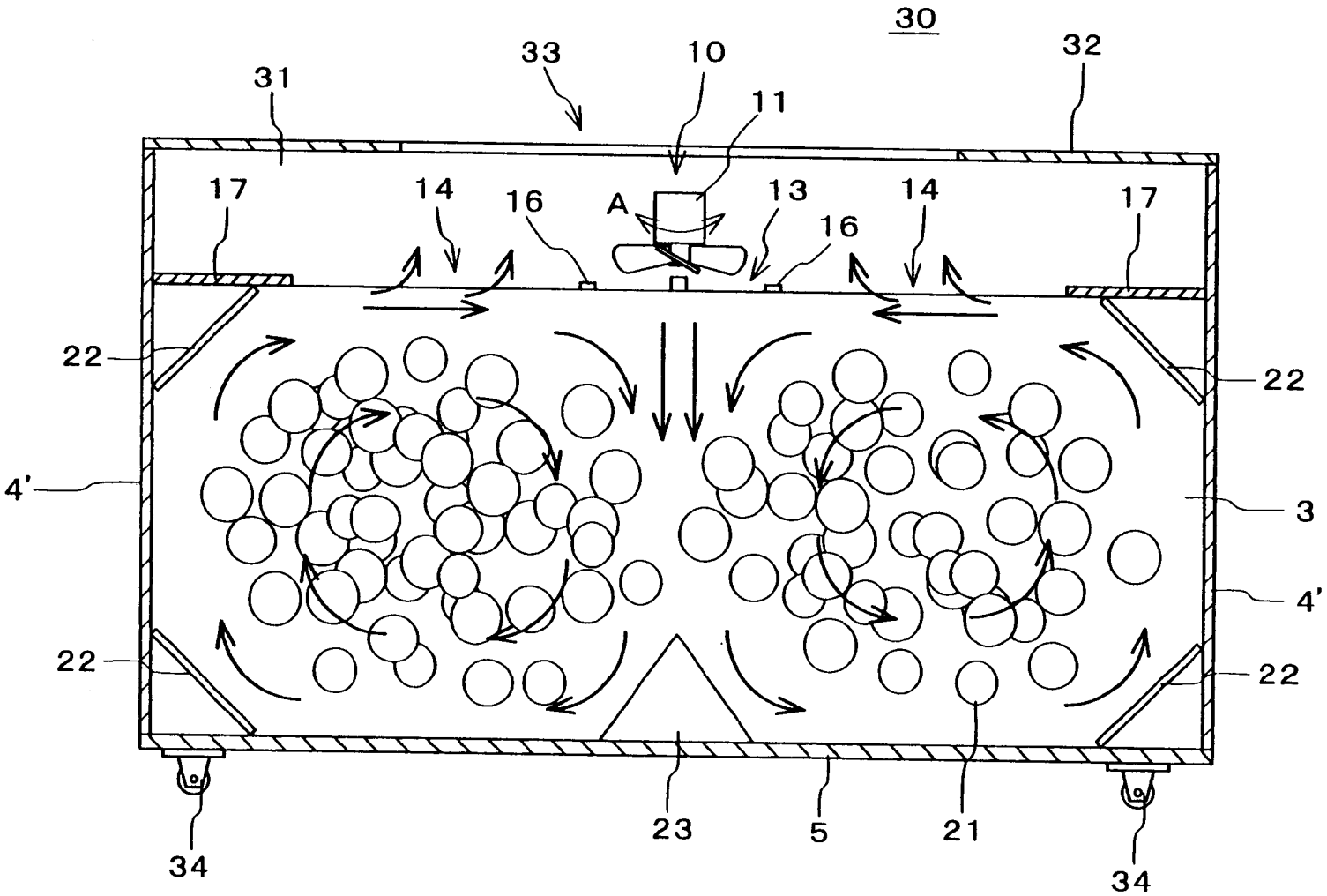
FIG. 5 is a sectional view illustrating a decorative display apparatus according to another embodiment of the invention.

Another embodiment of the present invention will next be explained with reference to FIG. 5. As shown in FIG. 5, a decorative display apparatus 30 according to this embodiment has substantially the same construction as the decorative display apparatus 1 shown in FIGS. 1 and 2. Therefore, like components are denoted by like reference characters, and a detailed explanation will not be given thereto.

As shown in FIG. 5, the decorative display apparatus 30 has an upper space defined by a pair of panels 3, 3, upwardly extending portions of side plates 4, 4 and panels 31, 32. Air supply means 10 is provided within the upper space, and casters 34 are provided on an under surface of a bottom plate 5. The panel 32 has an opening 33 through which air flows in and out.

The decorative display apparatus 30 provides the same effect as the decorative display apparatus 1 described above. In addition, the decorative display apparatus 30 can be installed inside or outside of a building, because the air supply means 10 is accommodated in an enclosure defined by the panels 3, 3, the bottom plate 5, the side plates 4, 4 and the panels 31, 32. Where the apparatus is installed inside the building, the apparatus can be used as a partition or a counter. Further, the provision of the casters 34 ensures easy transportation of the apparatus. If the apparatus is installed in a fixed position, there is no need to provide the casters 32 on the apparatus.

This embodiment may also be modified as in the preceding embodiment.

Figure 6:
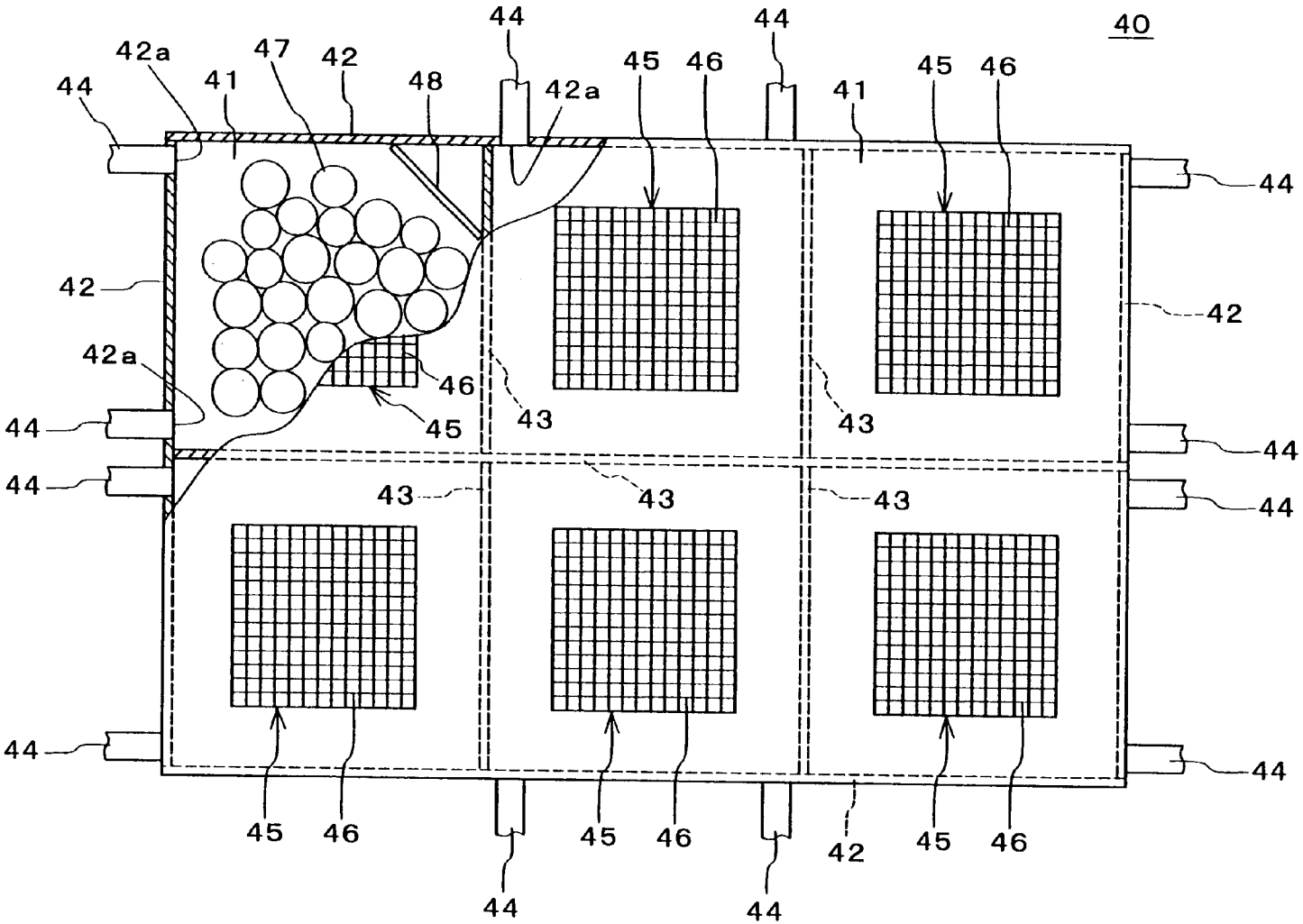
FIG. 6 is a front view illustrating a decorative display apparatus according to further another embodiment of the invention.

Further another embodiment of the present invention will next be explained with reference to FIG. 6. As shown in FIG. 6, a decorative display apparatus 40 includes: a pair of panels 41, 41 disposed in a spaced and parallel relation to define an inside space therebetween, at least one of the panels 41 being transparent or translucent; a peripheral frame 42 surrounding the inside space; partition plates 43 partitioning the inside space surrounded by the panels 41, 41 and the peripheral frame 42 into six partition spaces; air supply pipes 44 respectively connected air inlets 42*a* provided in the peripheral frame 42 for supplying air into the respective partition spaces; and balloons 47 retained in the respective partition spaces. The panels 41, 41 serve as the pair of opposed members, and the peripheral frame 42 and the partition plates 43 serve as the peripheral member in the invention.

The air inlets 42*a* are provided in pairs on corners of the respective partition spaces, and the air supply pipes 44 are also provided in pairs to be respectively connected to the air inlets 42*a* as described above. The air supply pipes 44 are connected to compressed air supply means (not shown) such as a compressor via associated selector valves (not shown). The selector valves (not shown) are each switched by an appropriate controller (not shown) for on-off control of the air supply into the respective partition spaces from the air supply pipes.

Air outlets 45 each provided with a mesh member 46 are provided in at least one of the panels 41 in positions associated with the centers of the respective partition spaces. Oblique plates 48 are provided in corners of the respective partition spaces diagonally opposite from the corners provided with the air inlets 42*a*.

When air is supplied into each of the partition spaces from one of the associated pair of air supply pipes 44 by switching the associated selector valves, a circling air stream is generated in the partition space, whereby the balloons 47 retained in the partition space is brought into circular motion as in the preceding embodiments. This provides the same effect as in the preceding embodiments. When air is supplied into the partition space only from the other air supply pipe 44, a circling air stream is generated in the opposite direction, so that the balloons are brought into circular motion in the opposite direction. Therefore, the directions of the circling movements of the balloons in the respective partition spaces can successively be reversed or changed by properly controlling the switching of the selector valves. Thus, the dynamic aesthetic effect can further be enhanced and diversified. Where the directions of the circling movements of the balloons are changed with music, for example, an aesthetic effect with an amusing taste can be provided. In this case, the amount of the air to be supplied by a blower 11 per unit time may be varied.

This embodiment may also be modified within a permissible range as in the preceding embodiments.

Figure 7:
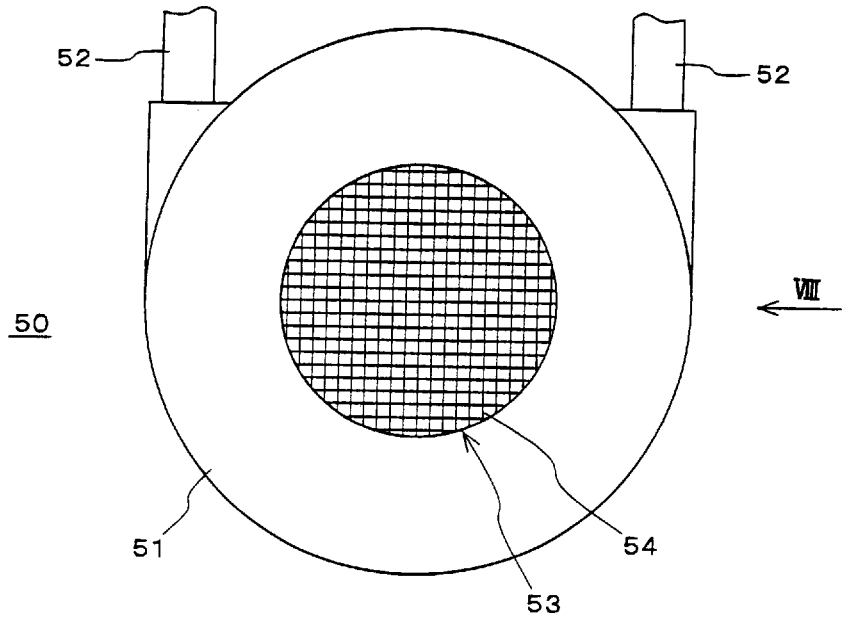
FIG. 7 is a front view illustrating a decorative display apparatus according to another embodiment of the invention.

Still another embodiment of the present invention will next be explained with reference to FIGS. 7 and 8. FIG. 7 is a front view illustrating a decorative display apparatus according to this embodiment, and FIG. 8 is a side view as seen in the direction of an arrow VIII in FIG. 7.

Figure 8:
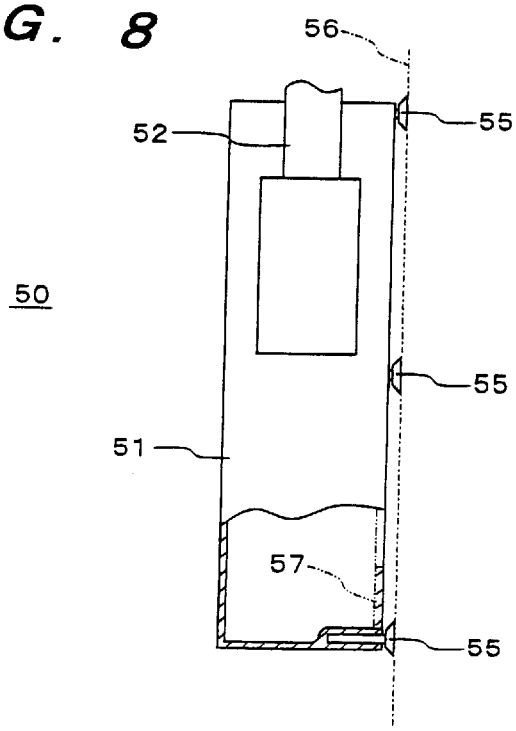
FIG. 8 is a side view as seen in the direction of an arrow VIII in FIG. 7.

As shown in FIGS. 7 and 8, the decorative display apparatus 50 includes: a hollow cylindrical body 51 having an open end; a plurality of balloons (not shown) retained in the body 51; and a pair of air supply pipes 52, 52 connected to connection ports formed in an outer circumference of the body 51 for supplying air along a tangent of the outer circumference of the body 51. At least an end face of the body 51 is transparent or translucent, and has an air outlet 53 provided in a central portion thereof and having a mesh member 54. Sucker means 55 are provided on an edge of the open end of the body 51. The sucker means 55 are brought into sucking engagement with a wall surface, a window glass, a floor surface or a ceiling surface 56 of a building for installation of the decorative display apparatus 50 thereon. The air supply pipes 44 are connected to compressed air supply means (not shown) via selector valves (not shown). The on-off control of the air supply into the inside space from the air supply pipes 44 is achieved by switching the selector valves (not shown) through an appropriate controller (not shown).

When air is supplied into the body 51 from either one of the air supply pipes 52 by switching the selector valves, the supplied air is guided along an inner circumference of the body 51, thereby easily forming a circling air stream. Thus, the balloons retained in the body 51 are brought into circling movement by the circling air stream, so that the same effect as in the preceding embodiments is provided. When air is supplied into the body 51 from the other air supply pipe 52, a circling air stream in the opposite direction is generated, whereby the balloons are brought into circling movement in the opposite direction. Therefore, the direction of the circling movement of the balloons can successively be reversed by properly controlling the switching of the selector valves. Thus, the dynamic aesthetic effect can further be enhanced.

Since the decorative display apparatus 50 is adapted to be mounted on the wall surface, the window glass, the floor surface or the ceiling surface 56 of the building by the sucking means 55, the installation thereof is very easy.

If the air flows out through a space between the body 51 and the wall surface or the ceiling surface 56, the speed of the circling air stream is reduced. In this respect, a flange 57 is preferably provided along an inner circumferential edge of the body 51 for prevention of the flow-out of the air.

Although the body 51 has a hollow cylindrical shape in this embodiment, the body 51 may have a hollow equilateral polygonal column shape as illustrated in FIG. 9. This also provides the same effect. In this case, the air supply pipes 52 are each connected to a connection portion formed in one of two adjacent faces of the body which define a corner of the body, and the air is supplied along an interior surface of the other face. Thus, the supplied air flows along interior surfaces of the equilateral polygonal column shaped body, thereby easily forming a circling air stream.

This embodiment may also be modified within a permissible range as in the preceding embodiments.

What is claimed is:

1. A decorative display apparatus comprising: a pair of opposed members disposed in a spaced and parallel relationship, at least one of the opposed members being transparent or translucent;

surrounding means, comprising a plurality of plates, for forming an inside space between the pair of opposed members, and an air inlet provided in one of said plates, solely for inletting air;

a plurality of balloons placed in the inside space;

air supply means for supplying air into the inside space from the air inlet to generate a circling air stream in the inside space; and at least one air outlet, solely for outletting air, separate from said air inlet by a fixture plate, provided adjacent the air inlet and in the same plate of the surrounding means.

2. A decorative display apparatus as set forth in claim 1, wherein at least one of the opposed members is rectangular in shape, and the surrounding means consists of four or more peripheral members, wherein the air inlet is provided in one of two adjacent peripheral members near a corner of the rectangular opposed member, and wherein the air supply means supplies the air into the inside space along the other of the two adjacent peripheral members.

3. A decorative display apparatus as set forth in claim 2, further comprising oblique plates disposed near the other corners of the rectangular opposed member, wherein each of the oblique plates connects to the two adjacent peripheral members providing each of the other corners to direct the air along the surrounding means to provide a circling air stream.

4. A decorative display apparatus as set forth in claim 2 or 3, wherein the rectangular plate member has an aspect ratio of 1.0 to 1.5.

5. A decorative display apparatus as set forth in claim 1, wherein at least one of the opposed members is a generally rectangular plate member which has an aspect ratio of 1.6 to 3.0, and wherein the air inlet is provided in a generally longitudinally middle portion of a face of the surrounding means along one of the longer sides of the plate member.

6. A decorative display apparatus as set forth in claim 5, further comprising oblique plates disposed near the four corners of the rectangular opposed member in the inside space with each of the oblique plates connecting the two adjacent peripheral member providing each of the corners to direct the air along the surrounding means to provide a circling air stream.

7. A decorative display apparatus as set forth in claim 5 or 6, further comprising diverting means opposed to the air inlet for diverting the air stream from the air inlet into two directions.

8. A decorative display apparatus as set forth in claim 1, wherein the air supply means is arranged to be pivoted about a support to supply the air in variable directions.

* * * * *